US007479841B2

(12) United States Patent
Stenger

(10) Patent No.: US 7,479,841 B2
(45) Date of Patent: Jan. 20, 2009

(54) TRANSMISSION LINE TO WAVEGUIDE INTERCONNECT AND METHOD OF FORMING SAME INCLUDING A HEAT SPREADER

(75) Inventor: Peter A. Stenger, Woodbine, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 150 days.

(21) Appl. No.: 11/057,127

(22) Filed: Feb. 15, 2005

(65) Prior Publication Data

US 2006/0182386 A1 Aug. 17, 2006

(51) Int. Cl.
*H01P 5/107* (2006.01)

(52) U.S. Cl. ..... 333/26; 333/33

(58) Field of Classification Search ..... 333/26, 333/33

See application file for complete search history.

(56) References Cited

U.S. PATENT DOCUMENTS 3,771,075 A 11/1973 Phelan ..... 333/246
5,132,648 A 7/1992 Trinh et al. ..... 333/128
5,235,300 A 8/1993 Chan et al. ..... 333/247
5,808,519 A * 9/1998 Gotoh et al. ..... 333/26
5,982,250 A * 11/1999 Hung et al. ..... 333/26
6,060,959 A * 5/2000 Yakuwa ..... 333/26
6,087,907 A * 7/2000 Jain ..... 333/26
6,320,546 B1 11/2001 Newton et al. ..... 343/700 MS
6,512,431 B2 1/2003 Pergande ..... 333/246
6,788,171 B2 9/2004 Ammar et al. ..... 333/247

* cited by examiner

*Primary Examiner*—Benny Lee
(74) *Attorney, Agent, or Firm*—Andrews Kurth LLP

(57) ABSTRACT

An MMIC chip is disclosed that includes a planar substrate having a first surface and a second surface, a conductive layer having an opening on the first surface, a transmission line on the second surface, at least one conductor extending from the conductive layer to the second surface defining a waveguide around the opening, wherein the transmission line is connected to the at least one conductor such that a signal traveling along the transmission line is guided toward the opening in the first side by the at least one conductor.

12 Claims, 5 Drawing Sheets

TRANSMISSION LINE TO WAVEGUIDE INTERCONNECT AND METHOD OF FORMING SAME INCLUDING A HEAT SPREADER

FIELD OF THE INVENTION

The present invention is directed toward an improved interconnect structure between a transmission line and a waveguide and a method for forming such an interconnect, and, more specifically, toward such an interconnect structure having a low reactive impedance at millimeter and microwave frequencies.

BACKGROUND OF THE INVENTION

Multichip modules (MCM) generally comprises a substrate, which may be, for example, a low temperature cofired ceramic (LTCC) material, and one or more chips, such as millimeter/microwave integrated circuits (MMIC), associated therewith. Connections must be provided between the chips and the substrate. These connections, however, may be difficult to manufacture and assemble and often limit the performance of the MCM.

An example of a conventional MCM is illustrated in FIGS. 8-10, wherein a gallium arsenide chip 102 is shown mounted adjacent a multilayer LTCC module 104. A ribbon or wire 106 extends between chip 102 and module 104 to carry signals between these elements. The ribbon 106 is attached to chip 102 with a first bonding pad 108 and to the LTCC module 104 with a second bonding pad 110. Ribbon 106 extends across a space or air gap 112 between the chip 102 and module 104. The length of this ribbon connection may be on the order of 0.025 inches. When the chip 102 is mounted on a thermal spreader, such as thermal spreader 114 illustrated in FIG. 10, the length of the ribbon may be even greater.

The inductive reactance presented by ribbon 106 is significant at millimeter wave (MMW) frequencies and contributes significantly to transmission losses. The need to tune out this reactance with printed capacitive elements and the variability of the length of ribbon 106 due to manufacturing constraints results in narrow band performance with unacceptable test yields for many MMW module applications. It would therefore be desirable to provide an interconnect that does not suffer from these shortcomings.

SUMMARY OF THE INVENTION

These and other problems are addressed by the present invention, which comprises, in a first embodiment, an MMIC chip that includes a planar substrate having a first surface and a second surface, a conductive layer having an opening on the first surface, and a transmission line on the second surface. At least one conductor extends from the conductive layer to the second surface and defines a waveguide around the opening, and the transmission line is connected to the at least one conductor. In this manner, a signal traveling along the transmission line is guided toward the opening in the first side by the at least one conductor.

Another aspect of the invention comprises a method of transitioning a signal from a first substrate transmission line to a second substrate waveguide that involves providing a first substrate having a ground plane on a first surface and a transmission line on a second surface and forming an opening in the ground plane so that a projection of the opening onto the second surface defines a waveguide opening. A plurality of vias are then formed around a periphery of the waveguide opening leaving a gap for the transmission line to enter the waveguide opening without crossing a via. The vias are plated with a conductive material, and the transmission line is connected to one of the vias opposite the gap. The ground plane opening is aligned with the second substrate waveguide, and the first substrate is attached to the second substrate.

An additional aspect of the invention comprises a multichip module comprising a module substrate having a waveguide and at least one chip, where the chip includes a planar chip substrate having a first surface and a second surface, a conductive layer having an opening on the first surface and a transmission line on the second surface. The chip also includes a plurality of vias extending from a periphery of the opening and defining a waveguide having a waveguide opening on the second surface, as well as defining a gap. The transmission line extends through the gap, across the waveguide, and connects to one of the vias. The chip is attached to the module substrate such that the conductive layer opening is aligned with the module substrate waveguide and signals propagating along the transmission line are guided by the vias into the module substrate waveguide.

BRIEF DESCRIPTION OF THE DRAWINGS

These and other aspects and features of embodiments of the present invention will be better understood after a reading of the following detailed description in connection with the following drawings wherein.

DETAILED DESCRIPTION OF THE INVENTION

Figure 1:
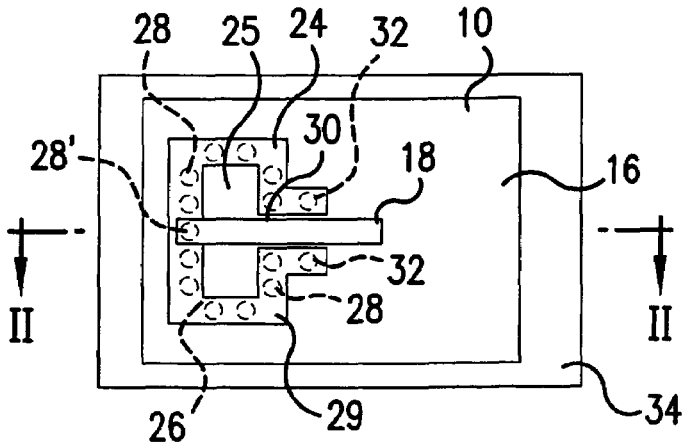
FIG. 1 is a top plan view of a chip on a module substrate illustrating an interconnect according to an embodiment of the present invention.
Figure 2:
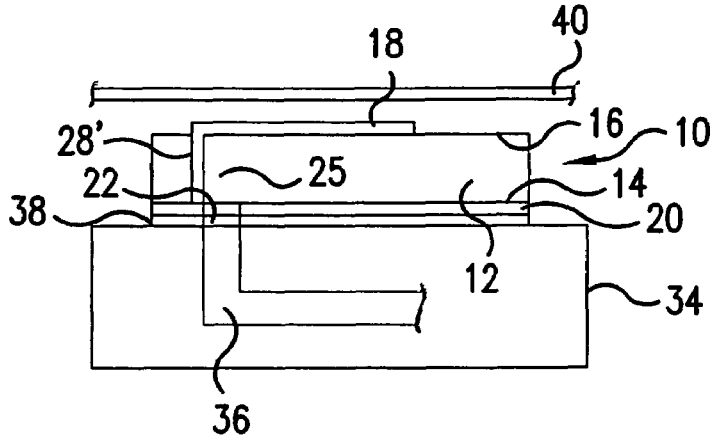
FIG. 2 is a sectional elevational view of the chip and substrate taken along line II-II of FIG. 1.
Figure 3:
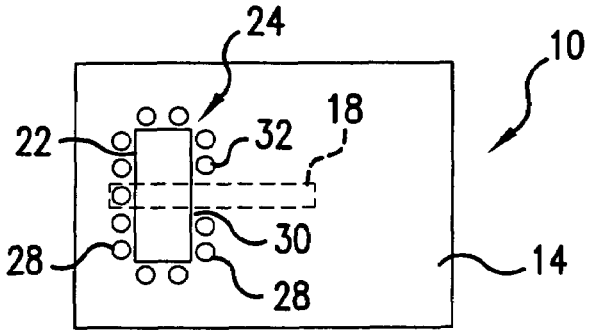
FIG. 3 is a bottom plan view of the chip of FIG. 1.

Referring now to the drawings, wherein the showings are for purposes of illustrating preferred embodiments of the invention only, and not for the purpose of limiting same, and wherein the figures are not drawn to scale, FIGS. 1-3 illustrate a chip 10, which may comprise, for example, a gallium arsenide chip, that includes a dielectric substrate 12 (e.g., FIG. 2) having a first side 14 (e.g., FIGS. 2, 3) and a second side 16 (e.g., FIGS. 1, 2) . A transmission line 18 is formed on second side 16, which transmission line in the present embodiment comprises a microstrip trace. A conductive layer of material 20 (e.g., FIG. 2) formed on first side 14 of substrate 12 serves as a ground plane. Signals propagate along transmission line 18 in a well-known manner.

An opening 22 (e.g., FIGS. 2, 3) having a periphery 24 (e.g. FIGS. 1, 3) is formed in conductive layer 20. A waveguide 25 (FIGS. 1,2) having a waveguide opening 26 (FIG. 1) on second side 16 is defined by a projection of this opening in the direction of second side 16. A plurality of vias 28 (e.g., FIGS. 1, 3)are formed from second side 16 to conductive layer 20 along periphery 24, and these vias are plated with a conductive material to physically and electrically connect them to conductive layer 20 and form waveguide 25 through the substrate 12. A layer of plating material 29 (e.g., FIG. 1) on second side 16 of substrate 12 electrically connects vias 28.

Vias 28 are arranged around waveguide opening 26 leaving a gap 30 (e.g., FIGS. 1, 3) through which transmission line 18 enters the waveguide 25. Transmission line 18 extends over waveguide 25 and connects to one of the vias 28' (e.g., FIGS. 1, 2) on the opposite side of waveguide opening 26 from gap 30. An approach to waveguide opening 26 may be partially defined by additional vias 32 (e.g., FIGS. 1, 3) which extend from the vias 26 adjacent gap 30 in a direction parallel to transmission line 18. This arrangement of vias 28, 32 allows signals traveling along transmission line 18 having a TEM mode to transition to the TE-10 mode supported by waveguide 25. The width of the transmission line in the vicinity of waveguide 25 can be varied for impedance matching purposes in a well-known manner.

Chip 10 may be attached to a substrate, such as an LTCC substrate 34 (e.g., FIGS. 1,2) having a waveguide 36 (e.g., FIG. 2) formed therein, by a layer of epoxy 38 (e.g., FIG. 2). The length of the printed trace 18 can be accurately controlled to within +/−1 micrometer using standard metal application processes. The thickness of the substrate 12 can also be accurately controlled. The only significant variability in the connection of chip 10 to substrate 34, therefore, is the alignment of the waveguide opening 22 on chip 10 and the opening of waveguide 36 on substrate 34. However, since any misalignment will be orthogonal to the direction of wave propagation, the misalignment will not change the length traversed by a signal. Thus, any misalignment should introduce less variability into such a system than was introduced by the variable length ribbons of conventional interconnects.

FIG. 2 illustrates a layer of absorbing material 40, which may be, for example, an elastomer that contains iron particles. This material is provided because, at MMW frequencies, the cavity surrounding the waveguide opening 26 is large enough to support and/or couple waveguide modes that can degrade performance significantly by causing feedback oscillations and phase/amplitude distortion. If the cavity can be kept below cut-off, then there is a possibility that the absorbing material could be omitted. However, conventional MCM designs, having bonds and bypass capacitors (not shown) located close to the chip to minimize inductance, generally will prevent the size of the enclosure surrounding chip 10 from being maintained below cut off, especially at MMW frequencies.

Figure 5:
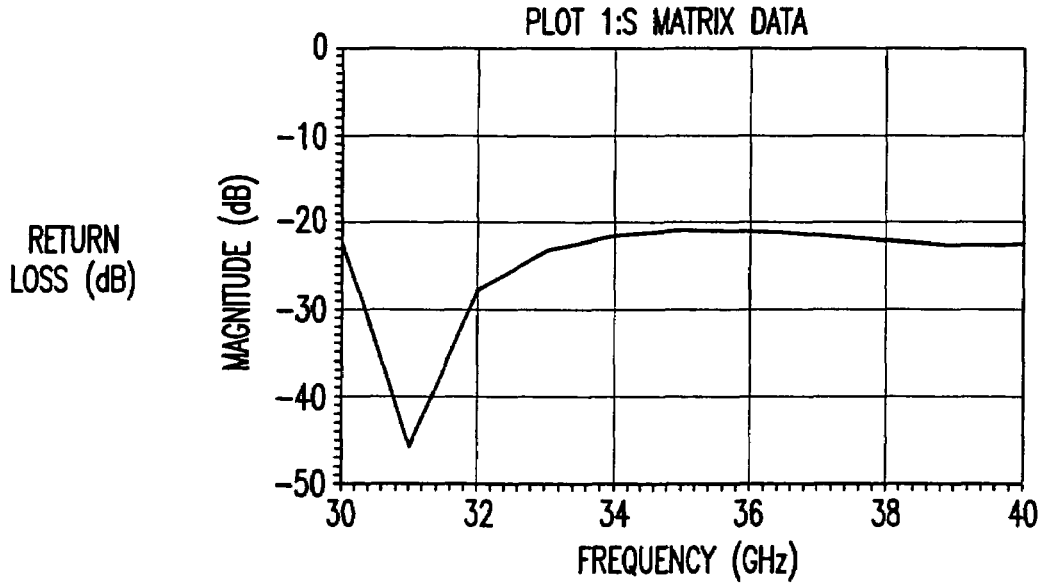
FIG. 5 is a graph of return loss vs. frequency for the interconnect of FIG. 1.

FIG. 5 illustrates the return loss in decibels vs. frequency in GHz response for the interconnect between chip 19 and the waveguide in substrate 34 for frequencies of 30 to 40 GHz. As is evident from this graph, a favorable return loss exists between 30 and 32 GHz, and the return loss is less than −20 dB over the entire range. It would be difficult or impossible to achieve such a low return loss over this range using conventional interconnect structures.

Figure 6:
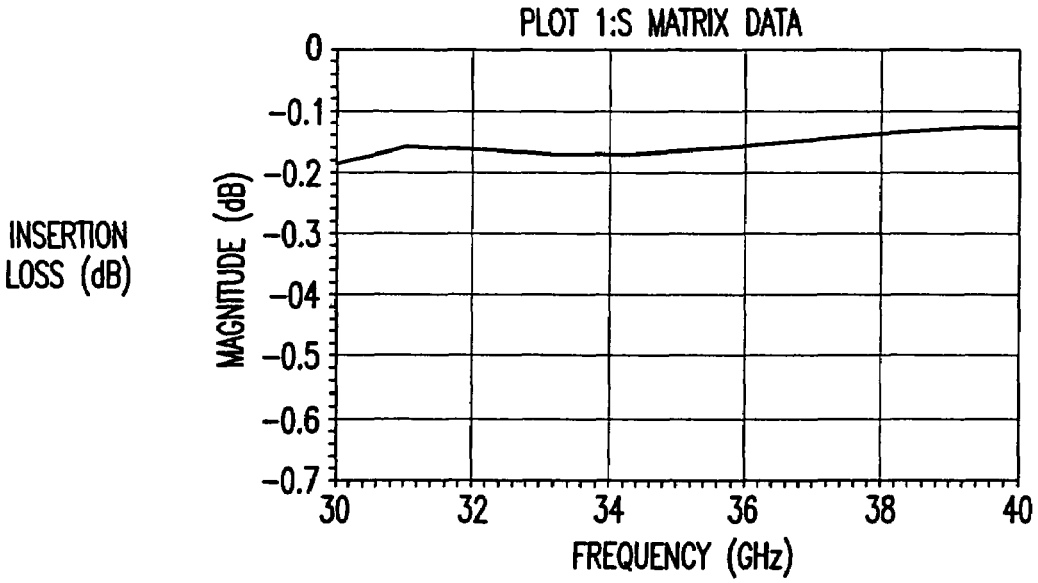
FIG. 6 is a graph of insertion loss vs. frequency for the interconnect of FIG. 1.

FIG. 6 illustrate the insertion loss vs. frequency in GHz response for the interconnect of FIG. 1. this graph shows a favorably low insertion loss, less than −0.1 dB, from 30 to 40 GHz.

Figure 4:
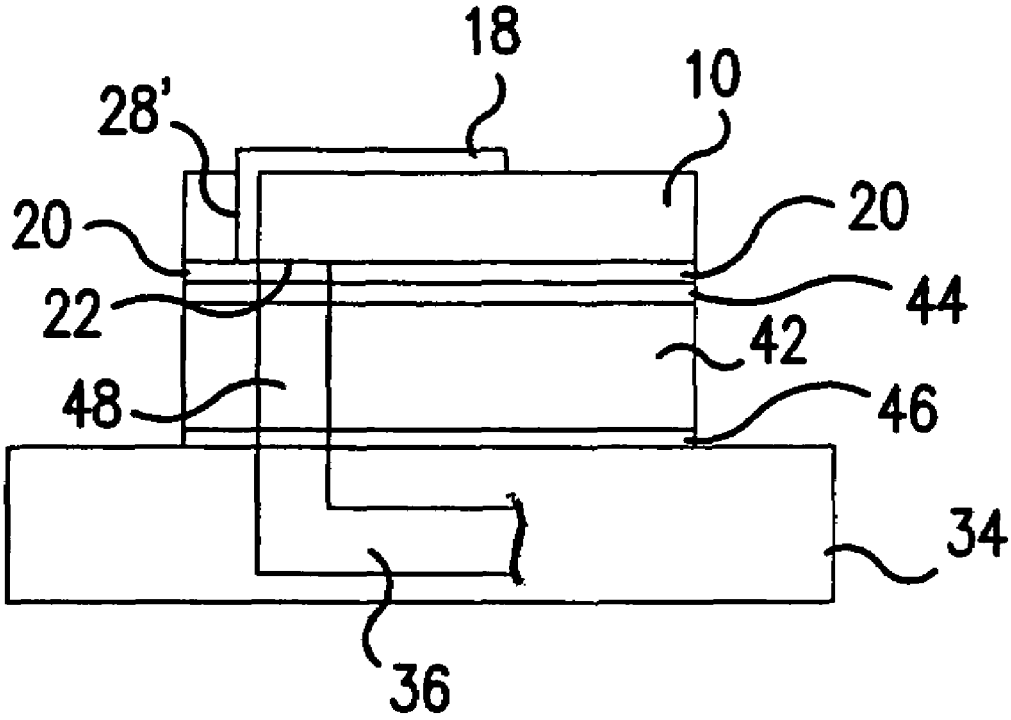
FIG. 4 is a side elevational view of a chip mounted on a thermal spreader that is mounted on a module substrate, illustrating an interconnect according to a second embodiment of the present invention.

FIG. 4 illustrates a second embodiment of the invention wherein the same reference numerals are used to identify elements common to the first embodiment and these reference numerals are not all described in detail herein. In this embodiment, a thermal spreader 42 is provided between chip 10 and substrate 34 to help dissipate heat generated by chip 10. A layer of solder 44 connects chip 10 to thermal spreader 42 while the thermal spreader 42 in turn is attached to substrate 34 with a layer of epoxy 46. A dielectric insert 48 is also provided in thermal spreader 42 to allow signals to move through the thermal spreader 42 to the waveguide 36 located below. As discussed in connection with the first embodiment, alignment errors orthogonal to the direction of wave propagation may occur, but length variability in the direction of wave propagation is reduced. Using the invention of the above described embodiments, therefore, can result in a reduction in reductive reactance of as much as 90 percent as compared to through-air interconnects using a long ribbon wire.

Figure 7:
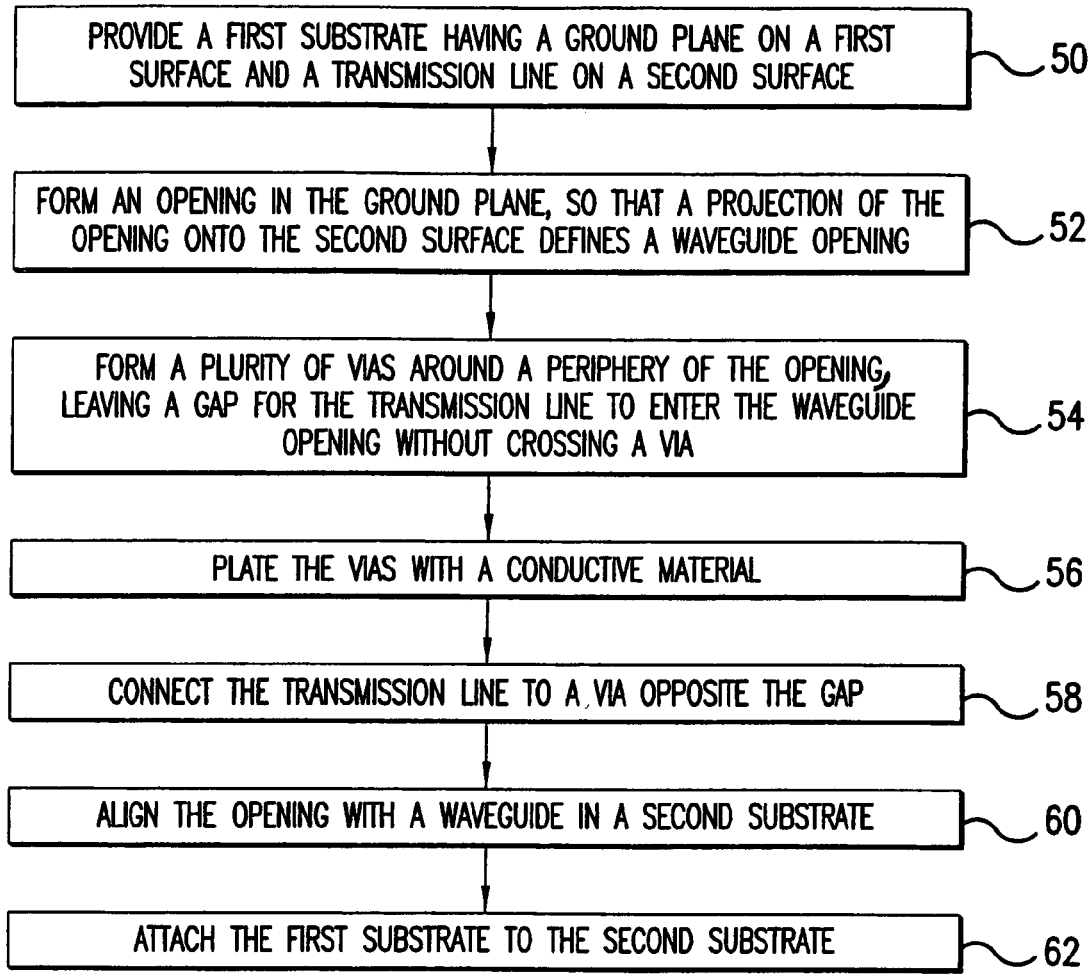
FIG. 7 is a flow chart illustrating a method for forming an interconnect according to an embodiment of the present invention.
Figure 8:
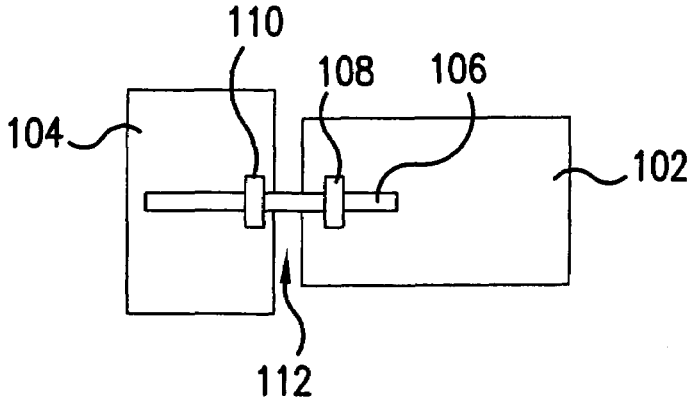
FIG.8 CONVENTIONAL ART
FIG. 8 is a top plan view of a conventional interconnect.
Figure 9:
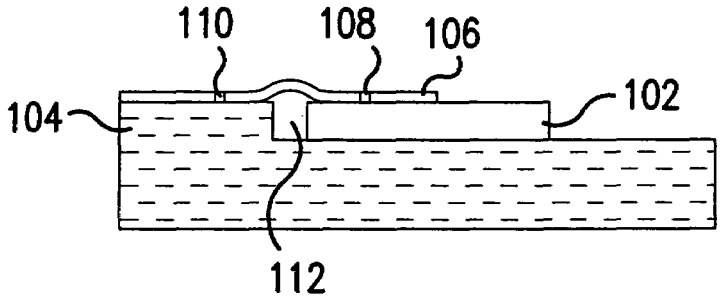
FIG.9 CONVENTIONAL ART
FIG. 9 is a side elevational view of the conventional interconnect of FIG. 8.
Figure 10:
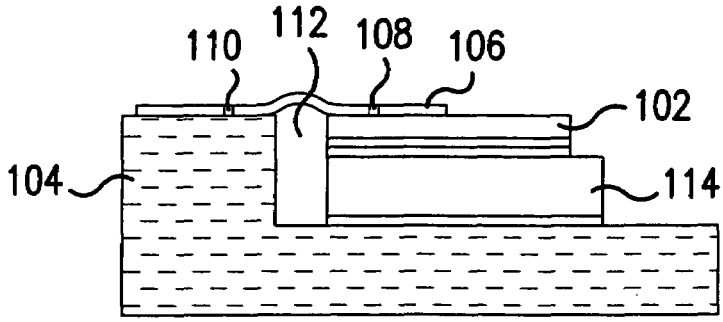
FIG.10 CONVENTIONAL ART
FIG. 10 is a side elevational view of a second conventional interconnect used with a chip mounted on a thermal spreader mounted on a module substrate.

FIG. 7 outlines a method of forming a low impedance interconnect between a chip and a substrate. At a first step 50, a first substrate is provided that has a ground plane on a first surface and a transmission line on a second surface. At a step 52, an opening is formed in the ground plane, which opening, when projected onto the opposite surface of the chip, defines a waveguide opening. A plurality of vias are formed around the opening at a step 54 leaving a gap for the transmission line to enter the waveguide opening without crossing a via. The vias are plated with a conductive material at a step 56 and the transmission line is connected to one of the vias at a step 58. The opening in the chip is aligned with a waveguide opening on a substrate at a step 60, and the chip is attached to the substrate at a step 62.

The subject invention has been described herein in terms of preferred embodiments. However, it should be recognized that obvious modifications and additions to these embodiments will become apparent to those skilled in the art upon a reading of the foregoing disclosure. It is intended that all such modifications and additions comprise a part of the present invention to the extent that they come within the scope of the several claims appended hereto.

The invention claimed is:

1. An MMIC chip comprising:

a planar substrate having a first surface and a second surface;

a conductive layer having a ground plane opening on said first surface;

a transmission line on said second surface;

at least one conductor extending from said conductive layer to said second surface defining a waveguide around said opening, said transmission line being connected to said at least one conductor, wherein a projection of said opening defines a waveguide opening defined by a plurality of vias formed in the MMIC chip, leaving a gap for said transmission line to cross an edge of said waveguide opening, wherein the plurality of vias are plated with a conductive material, and wherein the transmission line is connected to one of the plurality of plated vias located opposite the gap; and a second substrate including a second substrate waveguide and a thermal spreader having a dielectric insert aligned with the second substrate waveguide, wherein the ground plane opening is aligned with the substrate waveguide by aligning the opening with the dielectric insert, and wherein the planar substrate is attached to the second substrate.

2. The MMIC of claim 1 wherein said chip comprises gallium arsenide and said transmission line comprises a microstrip trace.

3. The MMIC chip of claim 1 wherein said transmission line extends through said gap.

4. The MMIC chip of claim 3 wherein said at least one conductor includes first and second portions extending from said gap parallel to said transmission line, thereby defining an approach path through which said transmission line approaches said waveguide opening.

5. The MMIC of claim 1 wherein said plurality of plated vias are interconnected by a conductive layer on said second surface.

6. The MMIC chip of claim 1 wherein said plurality of plated vias are disposed around a periphery of said conductive layer opening.

7. The MMIC chip of claim 1 including additional vias defining an approach path for said transmission line to said waveguide opening.

8. A multichip module comprising a module substrate having a waveguide and at least one chip, said at least one chip comprising:

a planar chip substrate having a first surface and a second surface;

a conductive layer having a ground plane opening on said first surface;

a transmission line on said second surface; and a plurality of vias in said at least one chip extending from a periphery of said opening and defining a waveguide having a waveguide opening on said second surface, the waveguide opening having a gap, for said transmission line, to cross an edge of said waveguide opening, wherein, said at least one chip is attached to said module substrate such that said conductive layer opening is aligned with said module substrate waveguide and signals propagating along said transmission line are guided by said vias into said module substrate waveguide; and a second substrate including a second substrate waveguide and a thermal spreader having a dielectric insert aligned with the second substrate waveguide, wherein the ground plane opening is aligned with the substrate waveguide by aligning the opening with the dielectric insert, and wherein the planar chip substrate is attached to the second substrate.

9. The multichip module of claim 8 including additional vias adjacent said gap defining an approach path for said transmission line to said waveguide opening.

10. The multichip module of claim 8.wherein said at least one chip comprises gallium arsenide and said module substrate comprises low temperature cofired ceramic material.

11. A method of transitioning a signal from a transmission line to a waveguide comprising the steps of:

providing a first substrate having a ground plane on a first surface and the transmission line on a second surface;

forming an opening in the ground plane, a projection of the ground plane opening onto the second surface, to define a waveguide opening;

forming a plurality of vias around a periphery of the waveguide opening leaving a gap for the transmission line to cross an edge of the waveguide opening;

plating the plurality of vias with a conductive material;

connecting the transmission line to one of the plurality of plated vias located opposite the gap;

placing a thermal spreader having a dielectric insert on a second substrate with the dielectric insert aligned with the waveguide;

aligning the ground plane opening with the waveguide, wherein aligning the ground plane opening with the waveguide comprises aligning the ground plane opening with the dielectric insert; and attaching the first substrate to the second substrate.

12. The method of claim 11 including the additional step of providing a layer of radiation absorbing material near the waveguide opening.

* * * * *